US011137152B2

(12) United States Patent
Goel

(10) Patent No.: US 11,137,152 B2
(45) Date of Patent: Oct. 5, 2021

(54) METHOD AND APPARATUS FOR REDUCTION OF CONDENSATE RE-EVAPORATION DURING COOLING PART-LOAD DUTY CYCLING

(71) Applicant: Lennox Industries Inc., Richardson, TX (US)

(72) Inventor: Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 119 days.

(21) Appl. No.: 16/675,301

(22) Filed: Nov. 6, 2019

(65) Prior Publication Data

US 2020/0072481 A1 Mar. 5, 2020

Related U.S. Application Data

(62) Division of application No. 15/424,993, filed on Feb. 6, 2017, now Pat. No. 10,473,343.

(51) Int. Cl.

| | |
|---|---|
| ***F24F 3/14*** | (2006.01) |
| ***F24F 13/15*** | (2006.01) |
| ***F24F 13/22*** | (2006.01) |
| ***F24F 11/74*** | (2018.01) |
| ***F24F 1/0007*** | (2019.01) |

(Continued)

(52) U.S. Cl.

CPC ..... *F24F 3/1405* (2013.01); *F24F 1/0007* (2013.01); *F24F 1/0035* (2019.02); *F24F 3/001* (2013.01); *F24F 11/30* (2018.01); *F24F 11/74* (2018.01); *F24F 13/15* (2013.01);

(Continued)

(58) Field of Classification Search

CPC ..... F24F 3/1405; F24F 13/15; F24F 1/007; F24F 1/0035; F24F 13/30; F24F 13/222; F24F 3/001; F24F 2001/0051; F24F 2003/1446; F24F 2221/16; F24F 11/74; F24F 11/30; F24F 13/10; F24F 2140/40; F24F 11/83; F25B 39/02

See application file for complete search history.

(56) References Cited

U.S. PATENT DOCUMENTS 6,427,454 B1 * 8/2002 West ..... F24F 3/153 62/93

6,427,461 B1 8/2002 Whinery et al.

(Continued)

FOREIGN PATENT DOCUMENTS

WO WO-2013/109519 A1 7/2013

*Primary Examiner* — Elizabeth J Martin

(74) *Attorney, Agent, or Firm* — Shackelford, Bowen, McKinley & Norton, LLP

(57) ABSTRACT

An apparatus that includes a supply duct and a return duct fluidly coupled to the supply duct. A first evaporator is disposed between the supply duct and the return duct. A second evaporator is disposed between the supply duct and the return duct. A fresh-air intake is disposed between the supply duct and the return duct upstream of the first evaporator and the second evaporator. A first plurality of dampers are disposed upstream of the first evaporator. A second plurality of dampers are disposed upstream of the second evaporator. A divider panel is disposed between the first evaporator and the second evaporator. The divider panel directs air egressing the first plurality of dampers across the first evaporator and air egressing the second plurality of dampers across the second evaporator.

20 Claims, 8 Drawing Sheets

(51) Int. Cl.

| | |
|---|---|
| ***F24F 3/00*** | (2006.01) |
| ***F24F 11/30*** | (2018.01) |
| ***F24F 1/0035*** | (2019.01) |
| ***F24F 13/30*** | (2006.01) |

(52) U.S. Cl.
CPC ..... *F24F 13/222* (2013.01); *F24F 13/30* (2013.01); *F24F 2003/1446* (2013.01); *F24F 2221/16* (2013.01)

(56) References Cited

U.S. PATENT DOCUMENTS

| | | | | |
|---|---|---|---|---|
| 2008/0203866 | A1 | 8/2008 | Chamberlain | |
| 2014/0041401 | A1 | 2/2014 | Douglas | |
| 2014/0075977 | A1 | 3/2014 | Elliott et al. | |
| 2015/0204568 | A1* | 7/2015 | Thomas ..... | F24F 13/10 62/127 |

* cited by examiner

METHOD AND APPARATUS FOR REDUCTION OF CONDENSATE RE-EVAPORATION DURING COOLING PART-LOAD DUTY CYCLING

CROSS-REFERENCE TO RELATED APPLICATION

This patent application is a divisional of U.S. patent application Ser. No. 15/424,993, filed on Feb. 6, 2017. U.S. patent application Ser. No. 15/424,993 is incorporated herein by reference.

TECHNICAL FIELD

This application relates to introduction of ventilation air during partial-cooling load operation and more particularly, but not by way of limitation, to methods and systems for reducing re-evaporation of water during introduction of ventilation air.

BACKGROUND

During operation of a heating, ventilation, and air conditioning (HVAC) system, condensed moisture often accumulates on a surface of an evaporator. Such condensed moisture is representative of moisture that has been removed from air during operation of the HVAC system. Federal regulations typically specify a percentage of fresh air that must be introduced to an enclosed space over a specified period of time. In order to accomplish adequate ventilation, it is often necessary to circulate air through the HVAC system without operating an associated evaporator. Thus, during ventilation of fresh air, it is common for the condensed moisture to evaporate and be re-introduced into the enclosed space. Such a phenomenon increases relative humidity of the enclosed space thereby increasing the amount of moisture that must be removed by the HVAC system.

SUMMARY

This application relates to introduction of ventilation air during partial-cooling load operation and more particularly, but not by way of limitation, to methods and systems for reducing re-evaporation of water during introduction of ventilation air. In one aspect, the present invention relates to an apparatus. The apparatus includes a supply duct and a return duct fluidly coupled to the supply duct. A first evaporator is disposed between the supply duct and the return duct. A second evaporator is disposed between the supply duct and the return duct. A fresh-air intake is disposed between the supply duct and the return duct upstream of the first evaporator and the second evaporator. A first plurality of dampers are disposed upstream of the first evaporator. A second plurality of dampers are disposed upstream of the second evaporator. A divider panel is disposed between the first evaporator and the second evaporator. The divider panel directs air egressing the first plurality of dampers across the first evaporator and air egressing the second plurality of dampers across the second evaporator.

In another aspect, the present invention relates to a method for reducing condensate re-evaporation. The method includes arranging a divider panel between a first plurality of dampers and a second plurality of dampers. The first plurality of dampers direct air over a first evaporator and the second plurality of dampers directing air over a second evaporator. The method also includes selectively closing at least one of the first plurality of dampers and the second plurality of dampers responsive to deactivation of at least one of the first evaporator and the second evaporator. A speed of a blower is adjusted responsive to deactivation of at least one of the first evaporator and the second evaporator. Selectively closing at least one of the first plurality of dampers and the second plurality of dampers reduces evaporation of condensate present on the first evaporator and the second evaporator.

In another aspect, the present invention relates to a method of reducing condensate re-evaporation. The method includes operating a heating, air conditioning, and ventilation (HVAC) system in at least one of full cooling load, partial cooling load, and a ventilation mode. The HVAC system includes a first evaporator and a second evaporator. The method also includes directing air from the first plurality of dampers to the first evaporator and directing air from the second plurality of dampers to the second evaporator. At least one of the first plurality of dampers and the second plurality of dampers are selectively closed responsive to operation of the HVAC system in the at least one of full cooling load, partial cooling load, or the ventilation mode.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1A:
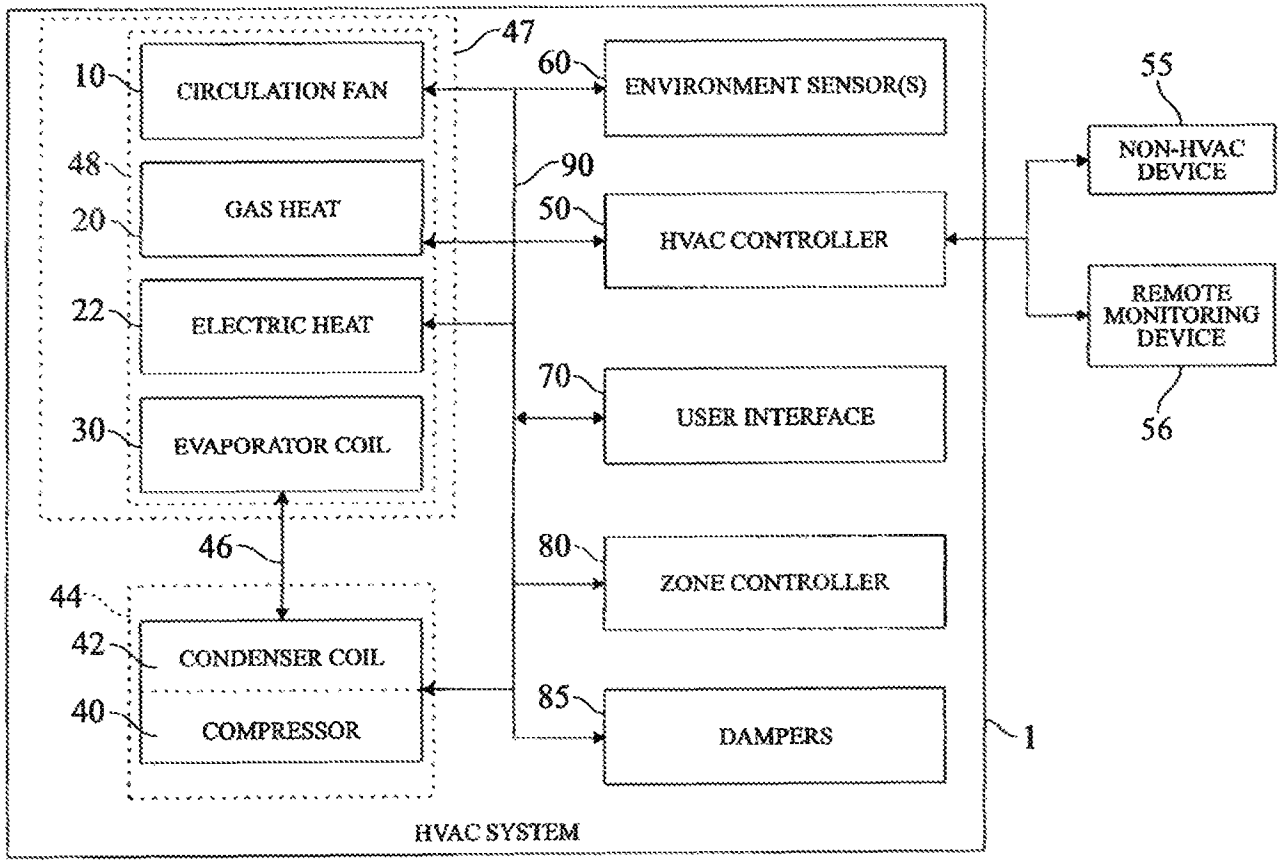
FIG. 1A is a block diagram of an HVAC system.

FIG. 1A illustrates an HVAC system 1. In a typical embodiment, the HVAC system 1 is a networked HVAC system that is configured to condition air via, for example, heating, cooling, humidifying, or dehumidifying air. The HVAC system 1 can be a residential system or a commercial system such as, for example, a roof top system. For exemplary illustration, the HVAC system 1 as illustrated in FIG. 1A includes various components; however, in other embodiments, the HVAC system 1 may include additional components that are not illustrated but typically included within HVAC systems.

The HVAC system 1 includes a variable-speed circulation fan 10, a gas heat 20, electric heat 22 typically associated with the variable-speed circulation fan 10, and a refrigerant evaporator coil 30, also typically associated with the variable-speed circulation fan 10. The variable-speed circulation fan 10, the gas heat 20, the electric heat 22, and the refrigerant evaporator coil 30 are collectively referred to as an "indoor unit" 48. In a typical embodiment, the indoor unit 48 is located within, or in close proximity to, an enclosed space 47. The HVAC system 1 also includes a variable-speed compressor 40 and an associated condenser coil 42, which are typically referred to as an "outdoor unit" 44. In various embodiments, the outdoor unit 44 is, for example, a rooftop unit or a ground-level unit. The variable-speed compressor 40 and the associated condenser coil 42 are connected to an associated evaporator coil 30 by a refrigerant line 46. In a typical embodiment, the variable-speed compressor 40 is, for example, a single-stage compressor, a multi-stage compressor, a single-speed compressor, or a variable-speed compressor. Also, as will be discussed in more detail below, in various embodiments, the variable-speed compressor 40 may be a compressor system including at least two compressors of the same or different capacities. The variable-speed circulation fan 10, sometimes referred to as a blower, is configured to operate at different capacities (i.e., variable motor speeds) to circulate air through the HVAC system 1, whereby the circulated air is conditioned and supplied to the enclosed space.

Still referring to FIG. 1A, the HVAC system 1 includes an HVAC controller 50 that is configured to control operation of the various components of the HVAC system 1 such as, for example, the variable-speed circulation fan 10, the gas heat 20, the electric heat 22, and the variable-speed compressor 40. In some embodiments, the HVAC system 1 can be a zoned system. In such embodiments, the HVAC system 1 includes a zone controller 80, dampers 85, and a plurality of environment sensors 60. In a typical embodiment, the HVAC controller 50 cooperates with the zone controller 80 and the dampers 85 to regulate the environment of the enclosed space.

The HVAC controller 50 may be an integrated controller or a distributed controller that directs operation of the HVAC system 1. In a typical embodiment, the HVAC controller 50 includes an interface to receive, for example, thermostat calls, temperature setpoints, blower control signals, environmental conditions, and operating mode status for various zones of the HVAC system 1. In a typical embodiment, the HVAC controller 50 also includes a processor and a memory to direct operation of the HVAC system 1 including, for example, a speed of the variable-speed circulation fan 10.

Still referring to FIG. 1A, in some embodiments, the plurality of environment sensors 60 is associated with the HVAC controller 50 and also optionally associated with a user interface 70. In some embodiments, the user interface 70 provides additional functions such as, for example, operational, diagnostic, status message display, and a visual interface that allows at least one of an installer, a user, a support entity, and a service provider to perform actions with respect to the HVAC system 1. In some embodiments, the user interface 70 is, for example, a thermostat of the HVAC system 1. In other embodiments, the user interface 70 is associated with at least one sensor of the plurality of environment sensors 60 to determine the environmental condition information and communicate that information to the user. The user interface 70 may also include a display, buttons, a microphone, a speaker, or other components to communicate with the user. Additionally, the user interface 70 may include a processor and memory that is configured to receive user-determined parameters, and calculate operational parameters of the HVAC system 1 as disclosed herein.

In a typical embodiment, the HVAC system 1 is configured to communicate with a plurality of devices such as, for example, a monitoring device 56, a communication device 55, and the like. In a typical embodiment, the monitoring device 56 is not part of the HVAC system. For example, the monitoring device 56 is a server or computer of a third party such as, for example, a manufacturer, a support entity, a service provider, and the like. In other embodiments, the monitoring device 56 is located at an office of, for example, the manufacturer, the support entity, the service provider, and the like.

In a typical embodiment, the communication device 55 is a non-HVAC device having a primary function that is not associated with HVAC systems. For example, non-HVAC devices include mobile-computing devices that are configured to interact with the HVAC system 1 to monitor and modify at least some of the operating parameters of the HVAC system 1. Mobile computing devices may be, for example, a personal computer (e.g., desktop or laptop), a tablet computer, a mobile device (e.g., smart phone), and the like. In a typical embodiment, the communication device 55 includes at least one processor, memory and a user interface, such as a display. One skilled in the art will also understand that the communication device 55 disclosed herein includes other components that are typically included in such devices including, for example, a power supply, a communications interface, and the like.

The zone controller 80 is configured to manage movement of conditioned air to designated zones of the enclosed space. Each of the designated zones include at least one conditioning or demand unit such as, for example, the gas heat 20 and at least one user interface 70 such as, for example, the thermostat. The zone-controlled HVAC system 1 allows the user to independently control the temperature in the designated zones. In a typical embodiment, the zone controller 80 operates electronic dampers 85 to control air flow to the zones of the enclosed space.

In some embodiments, a data bus 90, which in the illustrated embodiment is a serial bus, couples various components of the HVAC system 1 together such that data is communicated therebetween. In a typical embodiment, the data bus 90 may include, for example, any combination of hardware, software embedded in a computer readable medium, or encoded logic incorporated in hardware or otherwise stored (e.g., firmware) to couple components of the HVAC system 1 to each other. As an example and not by way of limitation, the data bus 90 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 90 may include any number, type, or configuration of data buses 90, where appropriate. In particular embodiments, one or more data buses 90 (which may each include an address bus and a data bus) may couple the HVAC controller 50 to other components of the HVAC system 1. In other embodiments, connections between various components of the HVAC system 1 are wired. For example, conventional cable and contacts may be used to couple the HVAC controller 50 to the various components. In some embodiments, a wireless connection is employed to provide at least some of the connections between components of the HVAC system such as, for example, a connection between the HVAC controller 50 and the variable-speed circulation fan 10 or the plurality of environment sensors 60.

Figure 1B:
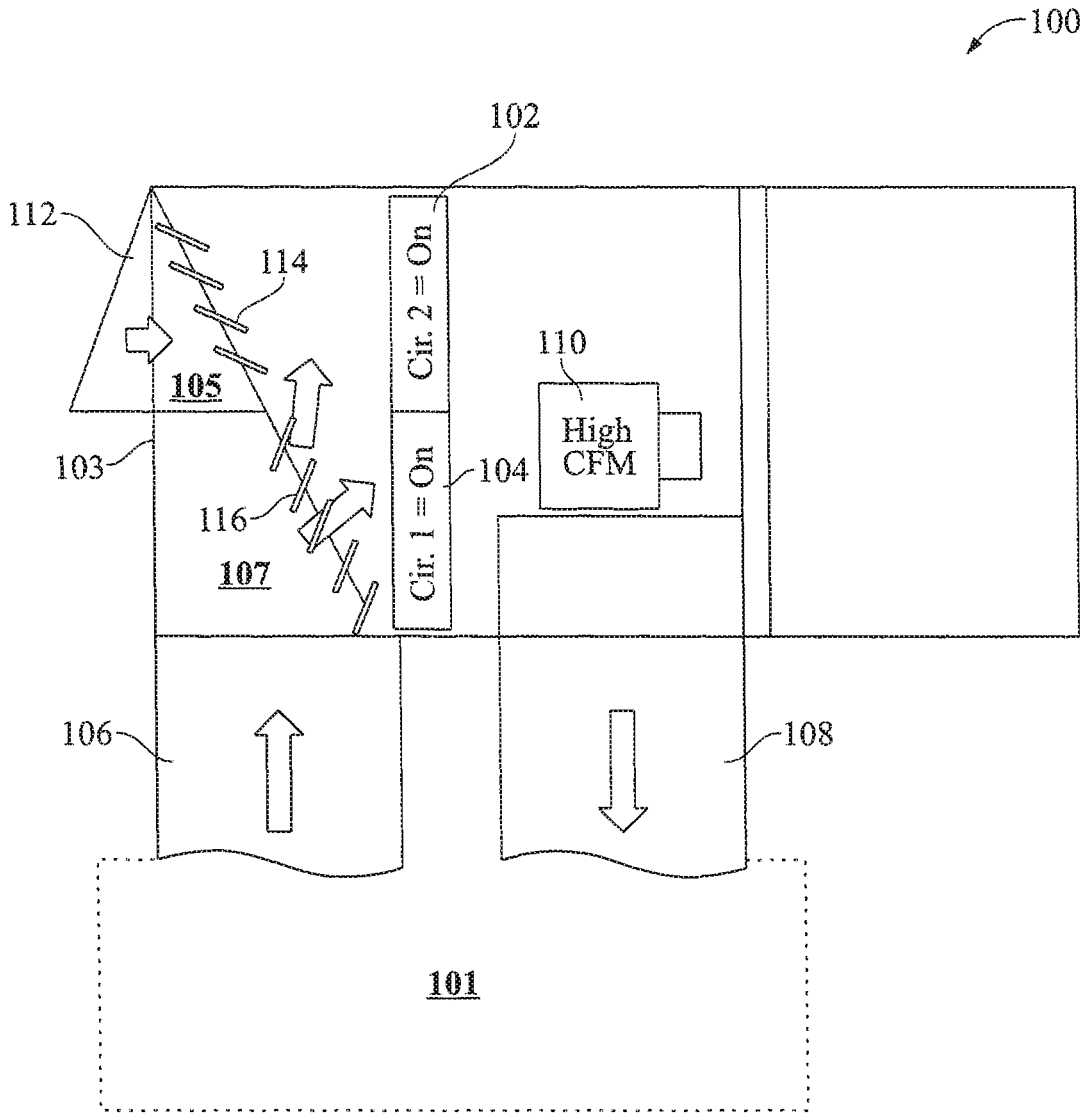
FIG. 1B is a schematic diagram of a current evaporator section operating at full cooling load.

FIG. 1B is a schematic diagram of a current evaporator section 100 operating at full cooling load. The evaporator section 100 includes a first evaporator 102 and a second evaporator 104 disposed therein. The evaporator section 100 is fluidly coupled to a return duct 106 and a supply duct 108. In a typical embodiment, the return duct delivers air to the evaporator section 100 from an enclosed space 101 while the supply duct 108 supplies conditioned air from the evaporator section 100 to the enclosed space 101. A blower 110 is disposed in the evaporator section 100 to facilitate movement of air through the evaporator section 100.

Still referring to FIG. 1B, the evaporator section 100 includes a plenum region 103. In a typical embodiment the plenum region 103 includes a first flow path 105 that is fluidly coupled to a fresh-air intake 112. A first plurality of dampers 114 are disposed at an exit of the first flow path 105 so as to direct air towards the first evaporator 102 and the second evaporator 104. A second plurality of dampers 116 are disposed at an exit of the second flow path 107 so as to direct air towards the first evaporator 102 and the second evaporator 104.

Still referring to FIG. 1B, during operation at full cooling load, the first evaporator 102 and the second evaporator 104 are operational. The blower 110 circulates air through the supply duct 108 and the return duct 106. The first plurality of dampers 114 and the second plurality of dampers 116 open sufficiently to direct air from the return duct 106 and the fresh-air intake 112 over the first evaporator 102 and the second evaporator 104. During operation at full cooling load, condensation forms on a surface of the first evaporator 102 and the second evaporator 104.

Figure 1C:
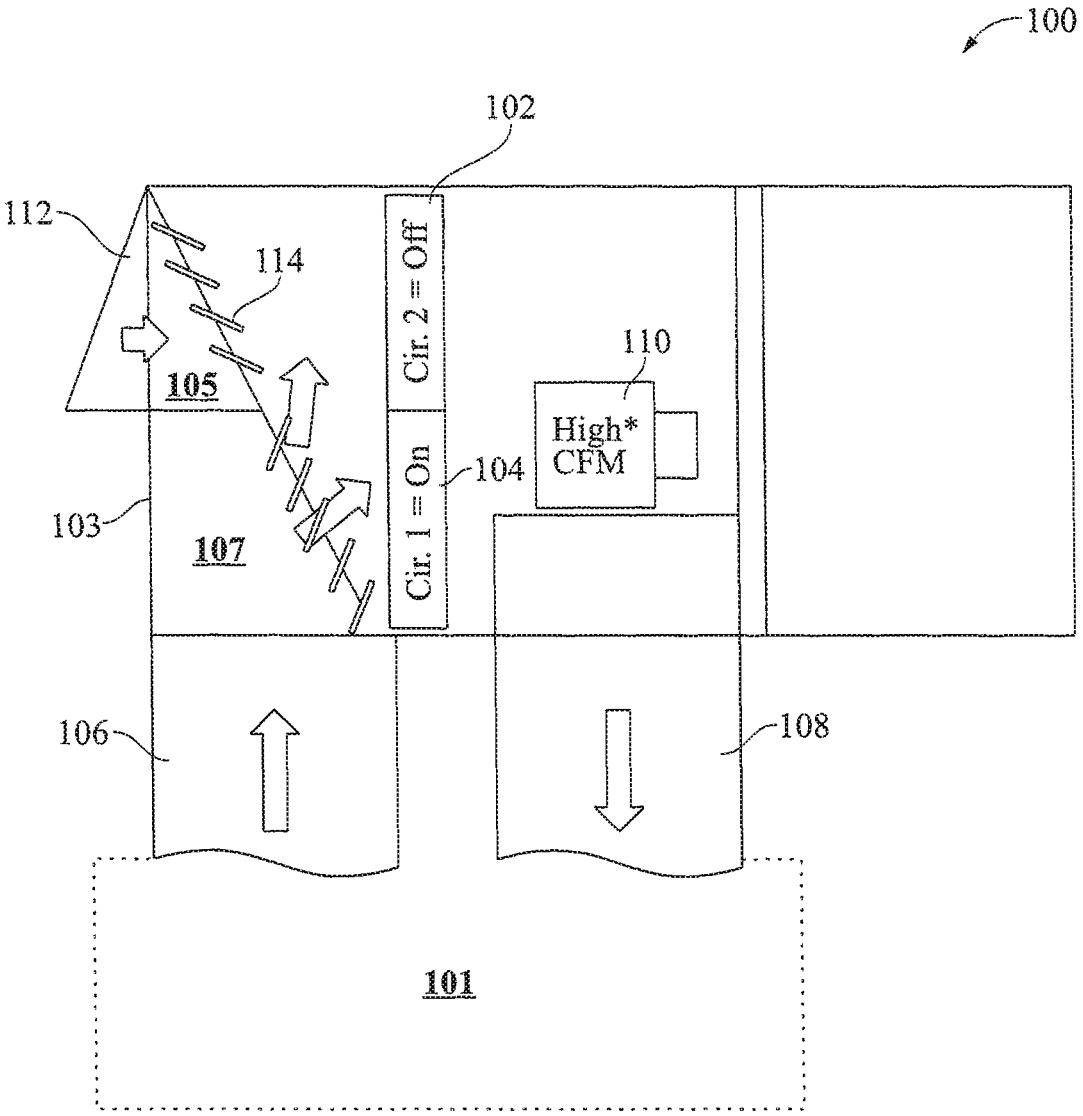
FIG. 1C is a schematic diagram of the current evaporator section operating at partial cooling load.

FIG. 1C is a schematic diagram of the current evaporator section 100 operating at partial cooling load. When operating at partial cooling load, the first evaporator 102 is deactivated and the second evaporator 104 remains active. The blower 110 circulates air through the supply duct 108 and the return duct 106. Generally, a position of the first plurality of dampers 114 and a position of the second plurality of dampers 116 remain unchanged so as to provide the same air face velocity to the evaporator 104.

Figure 1D:
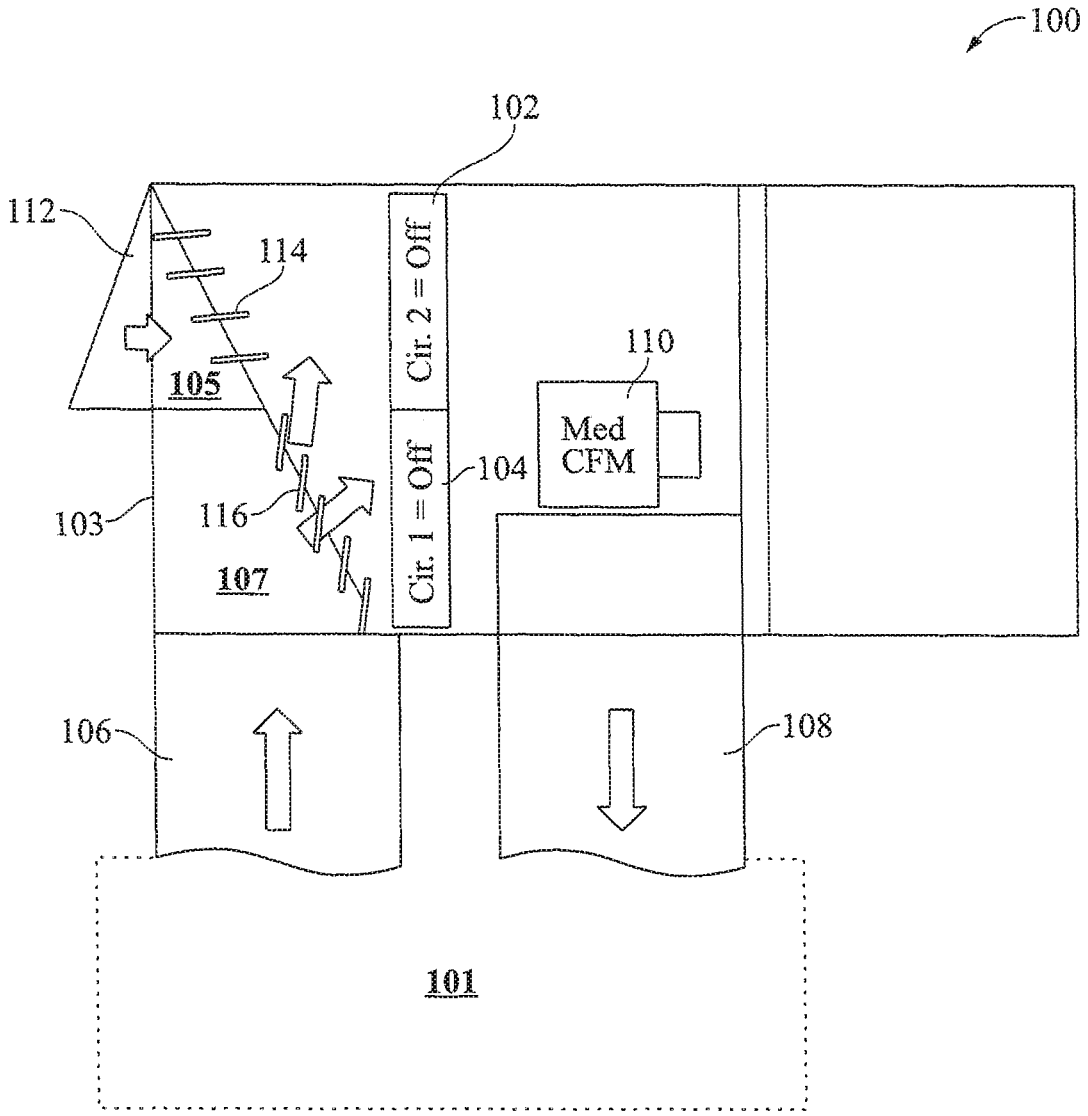
FIG. 1D is a schematic diagram of the current evaporator section operating in ventilation only mode.

FIG. 1D is a schematic diagram of the current evaporator section 100 operating in ventilation mode. During operation in ventilation mode, the first evaporator 102 and the second evaporator 104 are deactivated; however, the blower 110 continues to operate. The first plurality of dampers 114 open to allow a sufficient volume of fresh air into the enclosed space 101. The second plurality of dampers 116 are substantially closed in order to reduce the amount of air passing over the first evaporator 102 and the second evaporator 104. As fresh air is passed over the first evaporator 102 and the second evaporator 104, condensation that has formed on the surface of the first evaporator 102 and the second evaporator 104 is re-evaporated thereby increasing the relative humidity of the enclosed space 101 thereby increasing the amount of moisture that must be removed by the first evaporator 102 and the second evaporator 104 upon re-activation of the first evaporator 102 and the second evaporator 104. In some cases, the speed of the blower 110 may be reduced to match a desired volume of fresh air.

Figure 2A:
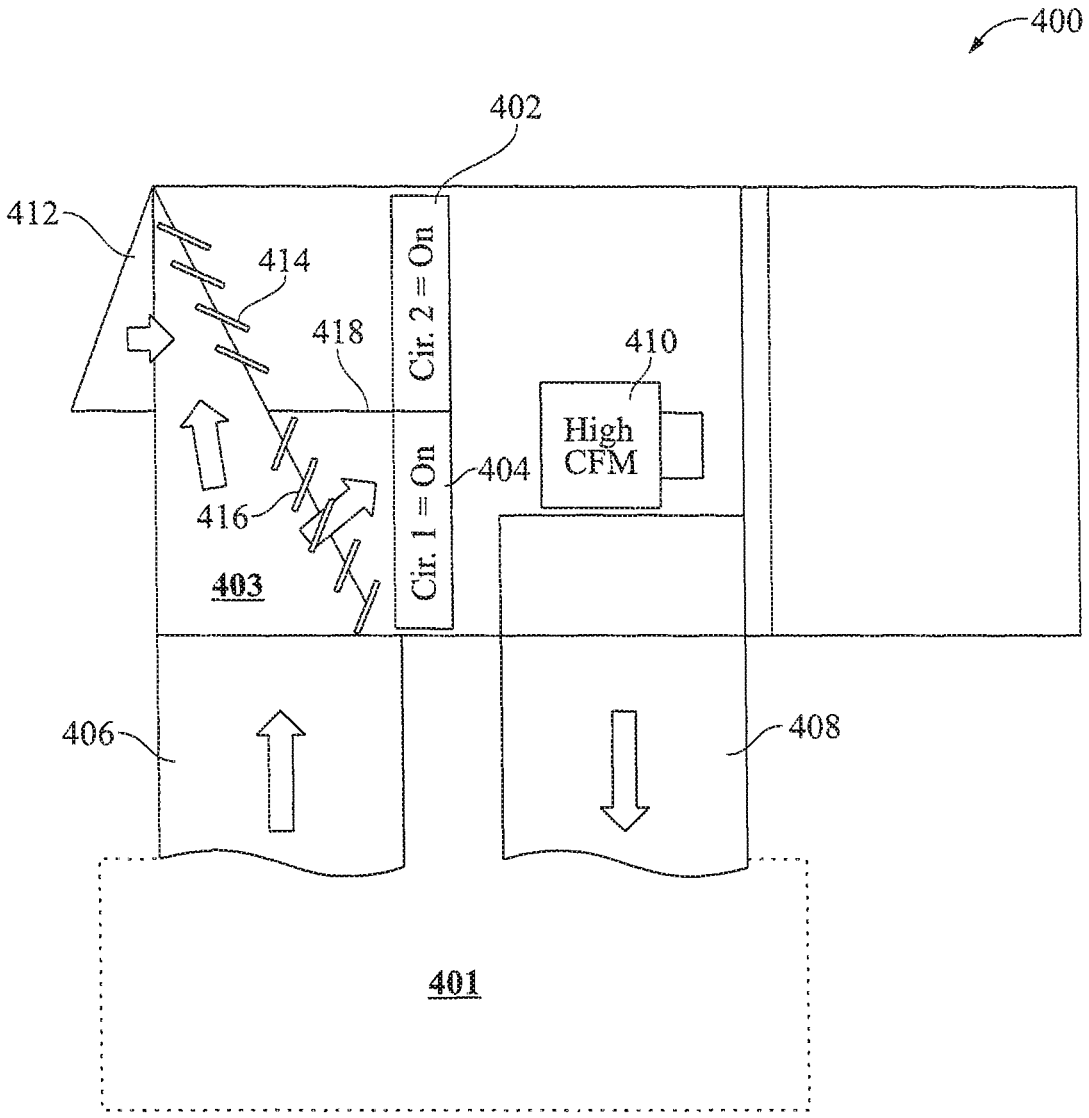
FIG. 2A is a schematic diagram of an exemplary evaporator section operating at full cooling load.

FIG. 2A is a schematic diagram of an exemplary evaporator section 400 operating at full cooling load. The evaporator section 400 includes a first evaporator 402 and a second evaporator 404 disposed therein. In a typical embodiment, the first evaporator 402 is disposed above the second evaporator 404; however, in other embodiments, other arrangements are possible. The evaporator section 400 is fluidly coupled to a return duct 406 and a supply duct 408. In a typical embodiment, the return duct 406 delivers air to the evaporator section 400 from an enclosed space 401 while the supply duct 408 supplies conditioned air from the evaporator section 400 to the enclosed space 401. A blower 410 is disposed in the evaporator section 400 and is configured to facilitate movement of air through the evaporator section 400. The evaporator section 400 includes a plenum region 403. In a typical embodiment the plenum region 403 is fluidly coupled to a fresh-air intake 412 and to the return duct 406. Air from the fresh-air intake 412 mixes with air from the return duct 406 in the plenum region 403. A first plurality of dampers 414 are disposed between the plenum region 403 and the first evaporator 402. A second plurality of dampers 416 are disposed between the plenum region 403 and the second evaporator 404. In a typical embodiment, the first evaporator 402, the second evaporator 404, the return duct 406, the supply duct 408, the blower 410, the fresh-air intake 412, the first plurality of dampers 414, and the second plurality of dampers 416 are similar in construction and operation to the first evaporator 102, the second evaporator 104, the return duct 106, the supply duct 108, the blower 110, the fresh-air intake 112, the first plurality of dampers 114, and the second plurality of dampers 116 discussed above with respect to FIGS. 1-3.

Still referring to FIG. 2A, in a typical embodiment, the evaporator section 400 is part of a commercial rooftop heating, ventilation, and air conditioning (HVAC) system; however, in other embodiments, the evaporator section 400 could be part of a residential HVAC system. A divider panel 418 is disposed between the first evaporator 402 and the second evaporator 404 downstream of the fresh-air intake 412. In a typical embodiment, the divider panel separates air egressing the first plurality of dampers 414 from air egressing the second plurality of dampers 416. In a typical embodiment, the divider panel 418 ensures that air egressing the first plurality of dampers 414 passes only over the first evaporator 402 and air egressing the second plurality of dampers 416 passes only over the second evaporator 404. During operation at full cooling load, the first plurality of dampers 414 and the second plurality of dampers 416 are opened to the degree necessary to allow sufficient ventilation of fresh air. When operating at full-cooling load, the blower 410 operates at a high speed such as, for example, approximately 350 to approximately 400 cfm/ton of full cooling load. In a typical embodiment a position of the first plurality of dampers 414 is adjusted via a first motor and a position of the second plurality of dampers 416 is adjusted via a second motor; however, in other embodiments, the position of the first plurality of dampers 414 and the position of the second plurality of dampers 416 may be adjusted by a motor that is common to both the first plurality of dampers 414 and the second plurality of dampers 416.

Figure 2B:
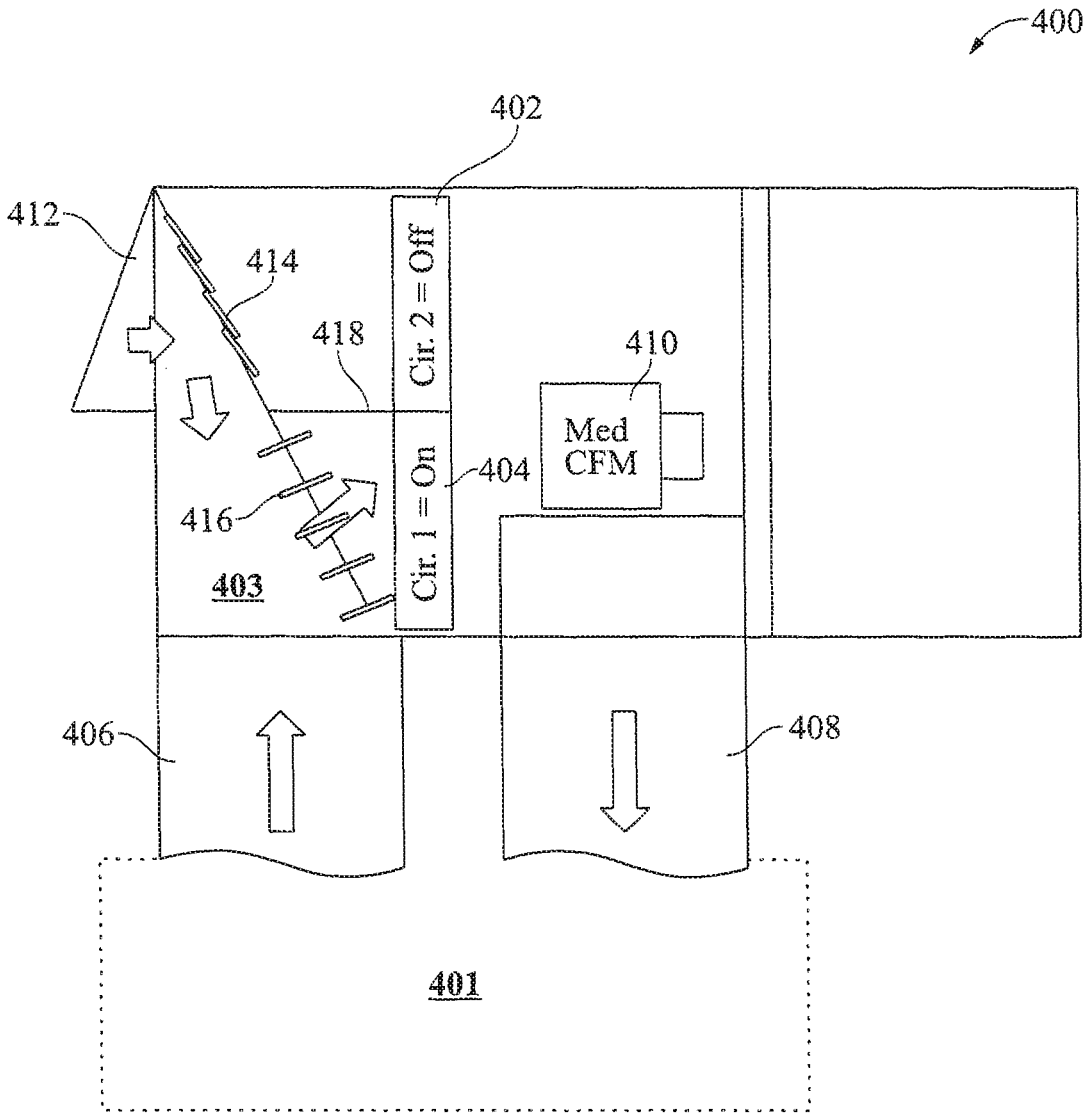
FIG. 2B is a schematic diagram of the exemplary evaporator section operating at partial-cooling load.

FIG. 2B is a schematic diagram of the exemplary evaporator section 400 operating at partial-cooling load. For purposes of discussion, FIG. 2B will be discussed herein relative to FIG. 2A. During operation at partial-cooling load, the first evaporator 402 is deactivated while the second evaporator 404 remains active. The first plurality of dampers 414 are closed so as to prevent air from flowing over the deactivated first evaporator 402. The second plurality of dampers 416 are fully opened so as to direct air over the active second evaporator 404. The divider panel 418 prevents air that egresses the second plurality of dampers 416 from passing over the deactivated first evaporator 402. Thus, condensate re-evaporation in the deactivated first evaporator 402 is minimized. In a typical embodiment, the divider panel 418 allows the air from the plenum region to be selectively directed to the first evaporator 402 and the second evaporator 404. When operating at partial-cooling load, a speed of the blower 410 is reduced to account for the reduced evaporator surface area while still maintaining circulation of needed fresh air such as, for example, approximately 350 to approximately 400 cfm/ton of partial-cooling load.

Figure 2C:
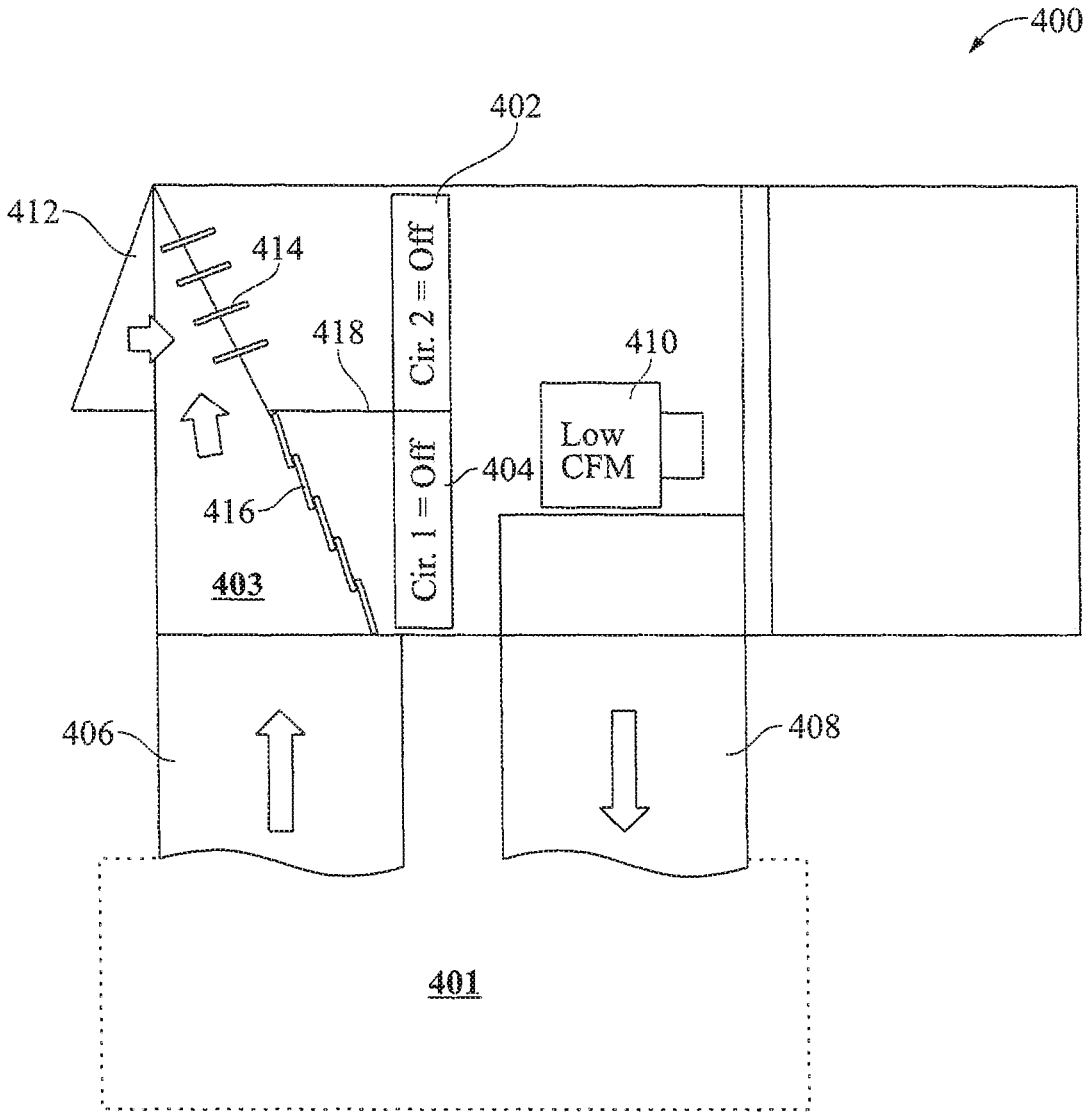
FIG. 2C is a schematic diagram of the exemplary evaporator section operating in ventilation-only mode.

FIG. 2C is a schematic diagram of the exemplary evaporator section 400 operating in ventilation mode. For purposes of discussion, FIG. 2C will be discussed herein relative to FIGS. 2A-2B. During operation in the ventilation mode, both the first evaporator 402 and the second evaporator 404 are deactivated. The first plurality of dampers 414 are fully opened to allow air to flow over the deactivated first evaporator 402 and the second plurality of dampers 416 are fully closed to prevent air from flowing over the deactivated second evaporator 404. The divider panel 418 prevents air that egresses the first plurality of dampers 414 from passing over the deactivated second evaporator 404. As a result, the first evaporator 402 exhibits less condensate formation compared to the second evaporator 404 due to the effect of gravity drawing condensate from the first evaporator 402 to the second evaporator 404. Thus, directing air flow over the first evaporator 402 while preventing airflow over the recently wet second evaporator 404 minimizes re-evaporation of condensate. Fresh-air that enters via the fresh-air intake 412 mixes with air from the return duct 406. When operating ventilation-only mode, a speed of the blower 410 is reduced to low speed to minimize a volume of air passing over the first evaporator 402 such as, for example, approximately 10% to approximately 30% of rated air flow rate.

Figure 3:
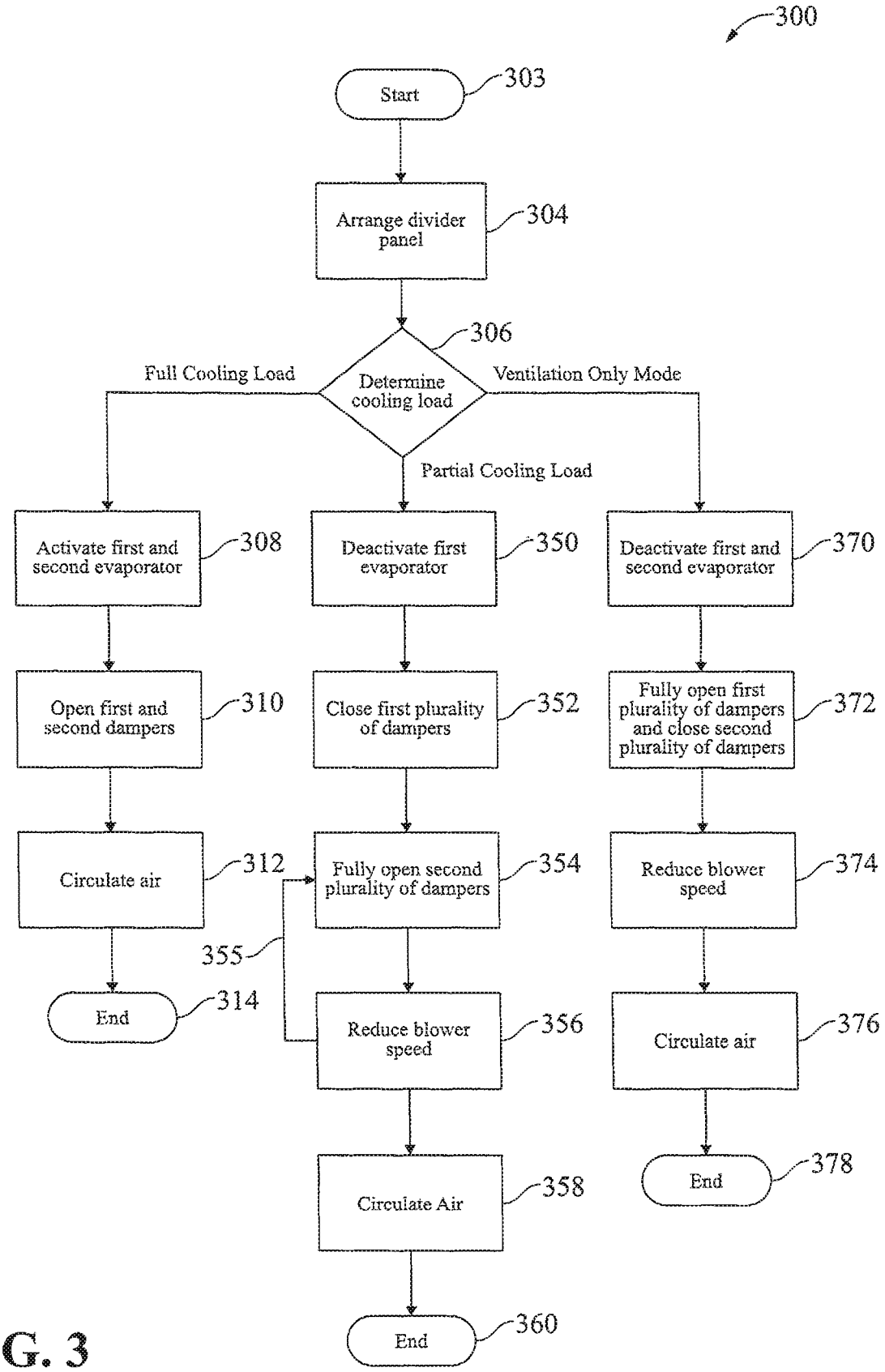
FIG. 3 is a flow diagram of a process for reducing condensate re-evaporation.

FIG. 3 is a flow diagram of a process 300 for reducing condensate re-evaporation. For purposes of discussion, FIG. 3 will be discussed herein relative to FIGS. 2A-2C. The process 300 begins at step 302. At step 304, a divider panel 418 is placed between the first evaporator 402 and the second evaporator 404 downstream of the fresh-air intake 412. At step 306, a cooling load of the evaporator section 400 is determined. In a typical embodiment, the evaporator section 400 is set to full-cooling load operation, partial-cooling load operation, or ventilation operation. If the evaporator section 400 is set to full-cooling load operation, the process 300 progresses to step 308. If the evaporator section 400 is set to partial-cooling load operation, the process 300 progresses to step 350. If the evaporator section 400 is set to ventilation-only operation, the process 300 progresses to step 370.

Still referring to FIG. 3, at step 308, both the first evaporator 402 and the second evaporator 404 are activated. At step 310 the first plurality of dampers 414 and the second plurality of dampers 416 are opened sufficient to satisfy fresh-air requirements for the enclosed space 401. At step 312, the blower 410 circulates air into the enclosed space via the supply duct 408. The process 300 ends at step 314.

Still referring to FIG. 3, at step 350, the first evaporator 402 is deactivated and the second evaporator 404 remains active. At step 352, the first plurality of dampers 414 are closed thereby preventing flow of air over the deactivated first evaporator 402. At step 354, the second plurality of dampers 416 are opened an increased amount thereby facilitating flow of air over the activated second evaporator 404. In a typical embodiment the divider panel 418 prevents air that egresses the second plurality of dampers 416 from passing over the deactivated first evaporator 402. Thus, condensate re-evaporation in the deactivated first evaporator 402 is minimized. Fresh-air that enters via the fresh-air intake 412 mixes with air from the return duct 406. At step 356, a speed of the blower 410 is reduced. In various embodiments, as illustrated by arrow 355, steps 354 and 356 are repeated interatively to achieve desired fresh air and circulation air across the active evaporator. At step 358, the blower 410 circulates air into the enclosed space 401 via the supply duct 408. The process 300 ends at step 360.

Still referring to FIG. 3, at step 370, the first evaporator 402 and the second evaporator 404 are deactivated. At step 372, the first plurality of dampers 414 are fully opened to allow air to flow over the deactivated first evaporator 402 and the second plurality of dampers 416 are fully closed to prevent air from flowing over the deactivated second evaporator 404. The divider panel 418 prevents air that egresses the first plurality of dampers 414 from passing over the deactivated second evaporator 404. In a typical embodiment, the first evaporator 402 will exhibit less condensate formation than the second evaporator 404. Thus, directing air flow over the first evaporator 402 while preventing airflow over the second evaporator 404 will minimize re-evaporation of condensate. At step 374, a speed of the blower 410 is reduced. At step 376, the blower 410 circulates air into the enclosed space 401 via the supply duct 408. The process 300 ends at step 378.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently. e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A method for reducing condensate re-evaporation in a heating, air conditioning, and ventilation (HVAC) system, the method comprising:

arranging a divider panel between a first plurality of dampers and a second plurality of dampers, the first plurality of dampers directing air over a first evaporator and the second plurality of dampers directing air over a second evaporator;

selectively closing at least one of the first plurality of dampers and the second plurality of dampers responsive to deactivation of at least one of the first evaporator and the second evaporator;

adjusting a speed of a blower responsive to deactivation of at least one of the first evaporator and the second evaporator; and wherein the selectively closing at least one of the first plurality of dampers and the second plurality of dampers reduces evaporation of condensate present on the first evaporator and the second evaporator.

2. The method of claim 1, wherein the selectively closing comprises closing the first plurality of dampers responsive to deactivation of the first evaporator.

3. The method of claim 2, wherein the divider panel prevents air from flowing over the first evaporator when the first plurality of dampers are closed.

4. The method of claim 1, wherein the selectively closing comprises closing the second plurality of dampers responsive to deactivation of the first evaporator and the second evaporator.

5. The method of claim 4, wherein the divider panel prevents air from flowing over the second evaporator when the second plurality of dampers are closed.

6. The method of claim 1, wherein the adjusting comprises reducing the speed of the blower responsive to deactivation of the first evaporator.

7. The method of claim 6, wherein the adjusting comprises further reducing the speed of the blower responsive to deactivation of the first evaporator and the second evaporator.

8. The method of claim 1, wherein the blower is configured to circulate air through the first plurality of dampers and the second plurality of dampers and over the first evaporator and the second evaporator.

9. The method of claim 1, comprising:

adjusting, using a common motor, a position of the first plurality of dampers and a position of the second plurality of dampers.

10. The method of claim 1, comprising operating the HVAC system in at least one of full cooling load, partial cooling load, and a ventilation mode.

11. The method of claim 10, wherein the first evaporator and the second evaporator are deactivated responsive to operation of the HVAC in the ventilation mode.

12. A method for reducing condensate re-evaporation in a heating, air conditioning, and ventilation (HVAC) system, the method comprising:

arranging a first plurality of dampers upstream of a first evaporator;

arranging a second plurality of dampers upstream of a second evaporator;

arranging a divider panel between the first evaporator and the second evaporator, the first plurality of dampers directing air over the first evaporator and the second plurality of dampers directing air over the second evaporator;

selectively closing at least one of the first plurality of dampers and the second plurality of dampers responsive to deactivation of at least one of the first evaporator and the second evaporator;

adjusting a speed of a blower responsive to deactivation of at least one of the first evaporator and the second evaporator; and wherein the selectively closing comprises closing the first plurality of dampers responsive to deactivation of the first evaporator.

13. The method of claim 12, wherein the divider panel prevents air from flowing over the first evaporator when the first plurality of dampers are closed.

14. The method of claim 12, wherein the adjusting comprises reducing the speed of the blower responsive to deactivation of the first evaporator.

15. The method of claim 14, wherein the adjusting comprises further reducing the speed of the blower responsive to deactivation of the first evaporator and the second evaporator.

16. The method of claim 12, wherein the blower is configured to circulate air through the first plurality of dampers and the second plurality of dampers and over the first evaporator and the second evaporator.

17. A method for reducing condensate re-evaporation in a heating, air conditioning, and ventilation (HVAC) system, the method comprising:

arranging a first plurality of dampers upstream of a first evaporator;

arranging a second plurality of dampers upstream of a second evaporator;

arranging a divider panel between the first evaporator and the second evaporator, the first plurality of dampers directing air over the first evaporator and the second plurality of dampers directing air over the second evaporator;

selectively closing at least one of the first plurality of dampers and the second plurality of dampers responsive to deactivation of at least one of the first evaporator and the second evaporator;

adjusting a speed of a blower responsive to deactivation of at least one of the first evaporator and the second evaporator; and wherein the selectively closing comprises closing the second plurality of dampers responsive to deactivation of the first evaporator and the second evaporator.

18. The method of claim 17, wherein the divider panel prevents air from flowing over the second evaporator when the second plurality of dampers are closed.

19. The method of claim 17, wherein the adjusting comprises reducing the speed of the blower responsive to deactivation of the first evaporator.

20. The method of claim 19, wherein the adjusting comprises further reducing the speed of the blower responsive to deactivation of the first evaporator and the second evaporator.

* * * * *